US006491472B1

(12) United States Patent
Lu

(10) Patent No.: US 6,491,472 B1
(45) Date of Patent: Dec. 10, 2002

(54) CONSTRUCTION METHOD FOR PROTECTING THE AIRPLANE RUNWAY SURFACE FROM BEING CRACKED TO SPIT OUT CRUSH STONES

(76) Inventor: Chia Lung Lu, Ste 5, 4Fl., No. 187, Dade 2nd Rd., Gangshan Jen, Kaoshiung (TW), 820

( * ) Notice: Subject to any disclaimer, the term of this patent is extended or adjusted under 35 U.S.C. 154(b) by 0 days.

(21) Appl. No.: 09/718,149

(22) Filed: Nov. 21, 2000

Related U.S. Application Data

(63) Continuation-in-part of application No. 09/349,771, filed on Jul. 9, 1999, now abandoned.

(51) Int. Cl.[7] ..... E01C 11/02; E01C 7/06
(52) U.S. Cl. ..... 404/74; 404/75
(58) Field of Search ..... 404/74, 75, 77, 404/79

(56) References Cited

U.S. PATENT DOCUMENTS

| | | | | | |
|---|---|---|---|---|---|
| 3,611,888 | A | * | 10/1971 | Kavalir et al. | 404/47 |
| 4,069,182 | A | * | 1/1978 | McDonald | 521/44.5 |
| 4,084,912 | A | * | 4/1978 | Pyle et al. | 404/74 |
| 4,109,033 | A | * | 8/1978 | Blankenhorn et al. | 427/314 |
| 4,162,998 | A | * | 7/1979 | Doi et al. | 523/450 |
| 4,252,487 | A | * | 2/1981 | Jeppson | 404/77 |
| 4,324,504 | A | * | 4/1982 | Cottingham et al. | 404/74 |
| 4,407,605 | A | * | 10/1983 | Wirtgen | 404/77 |
| 4,547,399 | A | * | 10/1985 | Fujihara et al. | 427/138 |
| 4,620,645 | A | * | 11/1986 | Hale | 222/146.2 |
| 4,684,288 | A | * | 8/1987 | Chapa | 404/35 |
| 4,765,772 | A | * | 8/1988 | Benedetti et al. | 404/77 |
| 5,183,353 | A | * | 2/1993 | Buckelew | 404/69 |
| 5,405,213 | A | * | 4/1995 | O'Connor | 404/77 |
| 5,513,925 | A | * | 5/1996 | Dempsey et al. | 404/17 |
| 5,556,225 | A | * | 9/1996 | Marino | 404/77 |
| 5,630,677 | A | * | 5/1997 | Barroso | 404/75 |
| 5,664,906 | A | * | 9/1997 | Baker et al. | 404/67 |
| 5,827,008 | A | * | 10/1998 | Smith et al. | 404/47 |
| 6,113,308 | A | * | 9/2000 | Johnson, II | 404/74 |

FOREIGN PATENT DOCUMENTS

| | | |
|---|---|---|
| DE | 31 31 722 | * 12/1982 |

* cited by examiner

*Primary Examiner*—Gary S. Hartmann
(74) *Attorney, Agent, or Firm*—Raymond Y. Chan; David and Raymond Patent Group

(57) ABSTRACT

A process is designed to finish all slits of the surface layer of an airplane runway. The process involves a first step in which a slit is heated such that the surface of the slit is dry, and that the capillary holes of the slit are opened up. The surface of the slit is then provided with a coating of an asphalt synthetic agent. The coating is subsequently heated to cause the molecules of the asphalt synthetic agent to diffuse into the capillary holes of the slit, thereby preventing the water from finding its way into the gradation layer of the runway. In the meantime, the slit is provided with a soft interface capable of preventing the water from finding its way into the slits of the surface layer of the runway. The soft interface is securely attached to the slits regardless of the climatic changes.

14 Claims, 17 Drawing Sheets

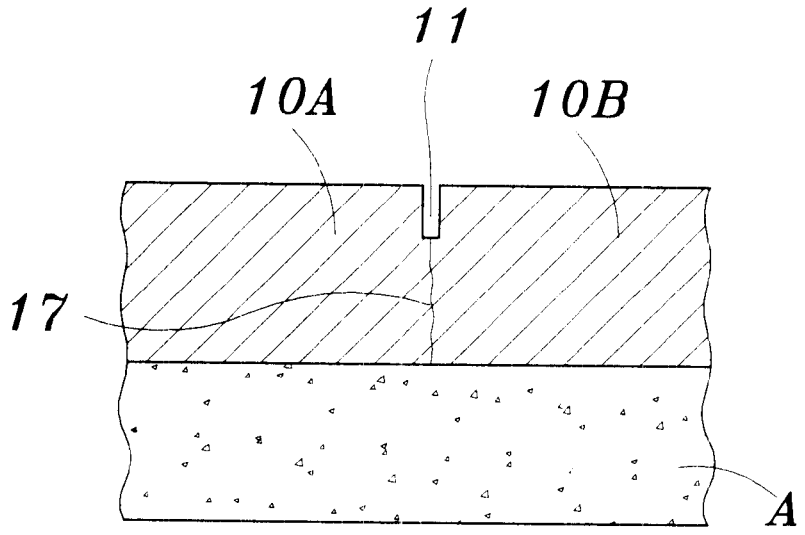
Fig. 4
Prior Art
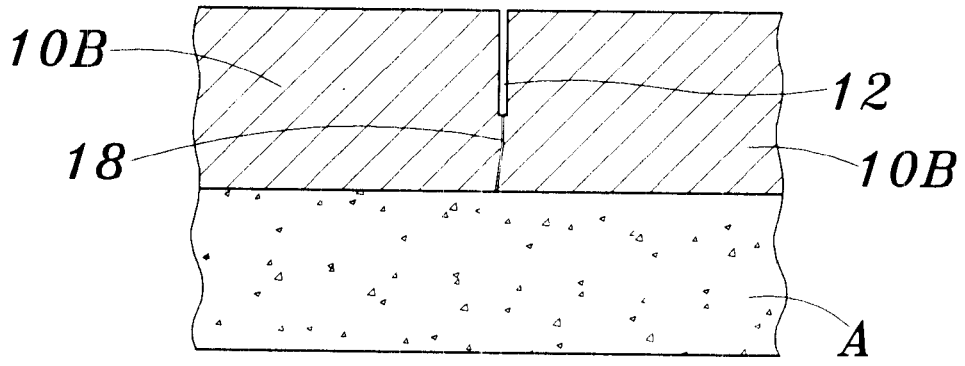
Fig. 5-A
Prior Art

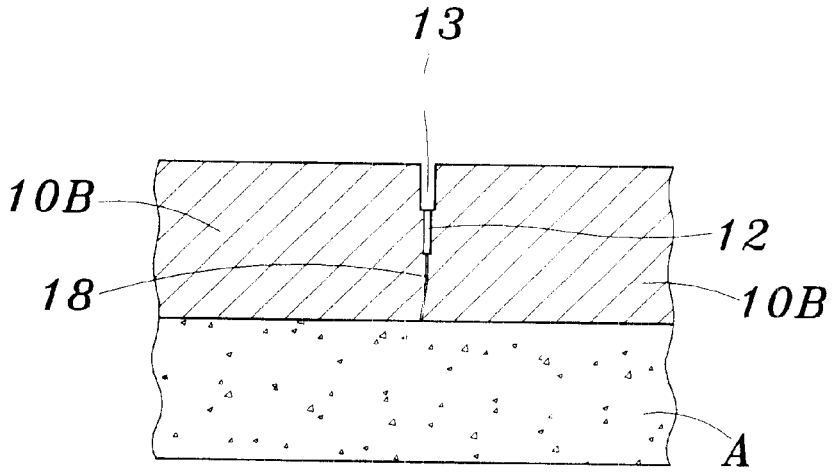
Fig.5-B
Prior Art
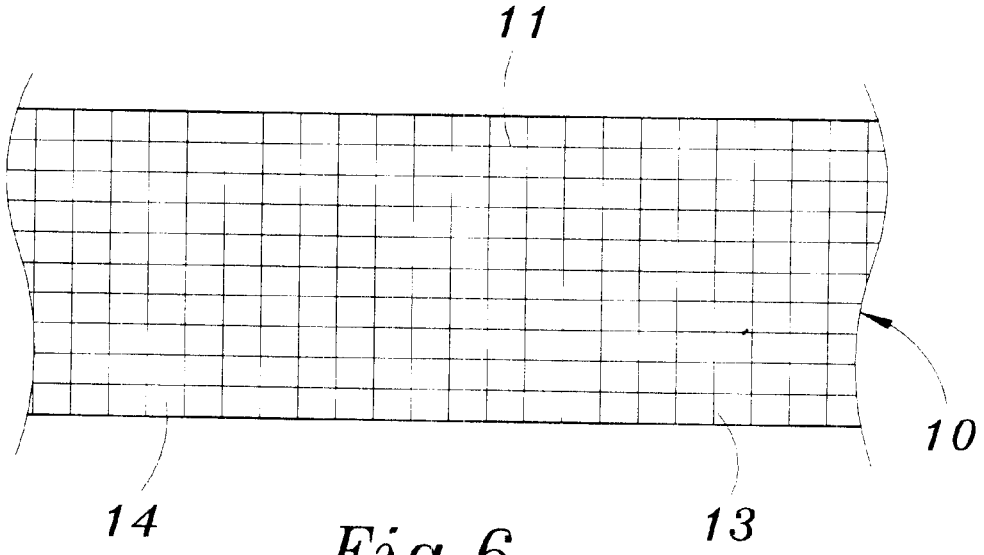
Fig.6
Prior Art

CONSTRUCTION METHOD FOR PROTECTING THE AIRPLANE RUNWAY SURFACE FROM BEING CRACKED TO SPIT OUT CRUSH STONES

CROSS REFERENCE OF RELATED APPLICATION

This is a Continuation-In-Part application of a non-provisional application, application Ser. No. 09/349,771, filed Jul. 9, 1999 now abandoned.

FIELD OF THE INVENTION

The present invention relates generally to the construction of airplane runway, and more particularly to processes of finishing slits of surface layers of runway, taxiway, apron, hangar, and the like.

BACKGROUND OF INVENTION

The conventional process of finishing slits of surface layers of the runway and the like is described and discussed hereinafter with reference to the accompanying FIGS. 1–20. The runway in question has a length of 3000 meters, a width of 60 meters, and a thickness of 30 centimeters.

As shown in FIG. 1, the runway is formed of a gradation layer A, and a surface layer 10 which is paved on the gradation layer A and is formed of pavement concrete (PC) or reinforced concrete (RC).

As shown in FIG. 2, the runway is provided on the gradation layer A with a plurality of first surface layer units 10A, which are parallel to one another at an interval of six meters and are equal in length to the runway. The surface layer units 10A are formed of pavement concrete or reinforced concrete.

As shown in FIG. 3, the runway surface layer 10 is further formed of a plurality of second surface layer units 10B, which are paved side by side with the first surface layer units 10A such that a second slit 17 is formed in the juncture of the first surface layer unit 10A and the second surface layer unit 10B.

As shown in FIG. 4, the surface layer 10 is provided with a longitudinally-oriected expansion slit 11, which is formed by cutting in the juncture of the first surface layer unit 10A and the second surface layer unit 10B. The expansion slit 11 has a depth of 3 cm, and a width of 1 cm.

As shown in FIG. 5A, the runway surface layer 10 is provided with hundreds of guide slits 12, which are arranged at a predetermined interval such that they are perpendicular to the length of the runway, The guide slits 12 are intended to prevent the formation of irregular cracks in the surface layer 10.

As shown in FIG. 5B, each of the guide slits 12 is provided with a horizontally-oriented expansion slit 13 which has a depth of 3 cm and a width of 1 cm, thereby resultion in formation of a number of checkers 14 on the surface layer 10, as shown in FIG. 6. The checkers 14 are intended to prevent the surface layer 10 from being damaged by the effects of expansion and contraction of the surface layer 10 due to the climatic factors.

As shown in FIGS. 7 and 8, the longitudinal expansion slit 11 and the horizontal expansion slit 13 are provided with a polyethylene (PE) strip 15 and a polyurethane (PU) slit-filling agent 16 covering the PE strip 15. The construction of the surface layer 10 is thus completed such that the runway is resistant to water.

The conventional process described above is also used to build taxiway, apron, hangar, and the like, The conventional process has several deficiencies, which are explicitly described hereinafter.

In light of the first surface layer units 10A and the second surface layer units 10B being constructed separately, there is formation of the second slit 17 in the juncture of the first surface layer unit 10A and the second surface layer unit 10B, as shown in FIGS. 3, 4, and 7. Upon completion of the guide slit 12, a through slit 18 is formed in such a way that it extends from the bottom of the guide slit 12 toward the gradation layer A, as shown in FIGS, 5A, 5B, and 8. The slit-filling agent 16 is coated on the inner walls of the longitudinal expansion slit 11 and the horizontal expansion slit 13, without penetration into the small holes of the inner walls of the expansion slits 11 and 13. As a result, the slit-filling agent 16 is apt to be stripped form the expansion slits 11 and 13 under the influence of the climatic changes, The slit-filling agent 16 is different in heat expansion coefficient from the first surface layer unit 10A, the second surface layer unit 10B, the pavement concrete, and the reinforced concrete. As a result, a water interstice 11' is formed between the longitudinal expansion slit 11 and the slit-filling agent 16, as shown in FIG. 9. Similarly, a water interstice 13' is formed between the horizontal expansion slit 13 and the slit-filling agent 16, as shown is FIG. 10. The water finds its way into the gradation layer A via the water interstice 11' and the second slit 17, as shown in FIGS. 7 and 9. Similarly, the water finds its way into the gradation layer A via the water insterstice 13', the guide slit 12 and the through slit 18, as shown in FIGS. 8 and 10. In light of the effect of the water erosion, A void A1 is formed in the gradation layer A, as shown in FIG. 11. The void A1 weakens the structural strength of the area in the vicinity of the longitudinal expansion slit 11. Such a weakened area of the surface layer 10 of the runway is apt to cave in when the surface layer 10 is exerted on by an external force of an airplane or heavy equipment, thereby resulting in formation of a pothole 19 in the surface layer 10 of the runway, as shown in FIG. 11. It is conceivably unsafe for an airplane to land or take off on a runway having potholes. The only workably remedy to provide the gradation layer A of the runway with protection against the water erosion is to replace the slit-filling agent 16 periodically. The periodic replacement of the slit-filling agent 16 is not cost-effective and is apt to hinder the normal operation of the airport.

The rain water tends to accumulate in those checkers 14 which are located in the juncture of the longitudinal expansion slit 11 and the horizontal expansion slit 13. As a result, the checkers 14 are susceptible to surface crack 14', as shown in FIG. 12. The surface crack 14' will eventually become a pothole 19, The conventional method of repairing the surface crack 14' involves a first step in which two slender slits 141 are formed by cutting along two longitudinal sides of the surface crack 14', as shown in FIG. 13. Thereafter, the surface layer 10 located between the two slender slits 141 is removed to form a shallow trench 142 which has a width of 30 cm and a depth of 10 cm, as shown in FIG. 14. As shown in FIG. 15, the shallow trench 142 is then filled with a filling material 20, which is a mixture containing water, epoxy resin quartz sand, pavement concrete, or reinforced concrete, The filling material 20 is different in heat expansion coefficient from the surface layer 10 and is therefore vulnerable to being separated from the side walls and the bottom wall of the shallow trench 142, thereby resulting in formation of a second process silt 21 between the filling material 20 and the shallow trench 142, as shown in FIG. 16. The water W enters from the second process slit 21 into the surface crack 14' which is located under the shallow trench 142. Subsequently, the water W enters the gradation layer A from the surface crack 14'. It is also likely that a gap 23 is formed between the bottom wall of the shallow trench 142 and the filling material 20, as shown in FIG. 17. This is due to the fact that the filling material 20 is exerted on by the expansion forces of the side walls of the shallow trench 142. As a result, the filling material 20 is partially jutted out of the shallow trench 142. The surface layer 10 of the runway is therefore rugged, In other words, the filling material 20 might become a culprit responsible for the flat tire.

In the event that the surface crack 14' is numerous, the surface layer 10 of the runway is replaced with a new surface layer. The process of paving a new surface layer involves a first step in which a thickness of 10 cm of the surface layer 10 is removed from the runway, so as to form an intermediate layer 10', as shown in FIG. 18. The intermediate layer 10' is sprayed with a layer of asphalt, thereby resulting in formation of a holding layer 101 on the intermediate layer 10'. The holding layer 101 is then paved with asphalt cement 30 having a thickness of about 5 cm. The asphalt cement layer 30 is covered with a pavement reinforcing fabric 40, which is made of polyacrylic fiber or polyester fiber. Finally, the pavement reinforcing fabric 40 is covered with an asphalt concrete layer 30, which has a thickness of 5 cm. A new runway surface layer 30' is thus completed, as shown in FIG. 19.

SUMMARY OF THE INVENTION

The primary objective of the present invention is to provide a process for finishing slits of the surface layer of an airplane runway in such a manner that the gradation layer of the airplane runway is immune from the water erosion, thereby prolonging the service life span of the airplane runway.

The process of the present invention is intended to overcome the deficiencies of the conventional processes described above. According to the process of the present invention, various slits of the surface layer of a runway are effectively resistant to water so as to minimize the water erosion of the gradation layer of the runway. The process of the present invention involves a first step in which the slits of the surface layer of the runway are properly heated to open up the capillary holes of the silts, so as to enhance the bonding of the asphalt synthetic agent with the side walls of the slits. As a result, various slits of the surface layer of the runway are effectively sealed off to an extent that the water is prevented from permeating into the gradation layer of the runway. The slits of the surface layer are further provided with a soft interface capable of preventing the formation of the second process slit, the surface crack, and the reflective crack.

The soft interface of the present invention is securely attached to the slits such that the chemical properties of the soft interface are not affected by the climatic changes, and that the soft interface is capable of converting a vertical internal stress into a horizontal action force, thereby preventing the formation of the reflective crack in the surface layer of the runway.

The process of the present invention involves the use of waterproof rubber cloth by which all slits of the surface layer of the runway are made waterproof. As a result, the gradation layer of the runway is free of voids which are caused by the water erosion. The use of the waterproof rubber cloth can also prevent the formation of the reflective crack in the surface layer of the runway. The process of the present invention eliminates the formation of potholes in the surface layer of the runway.

BRIEF DESCRIPTION OF THE DRAWINGS

FIG. 4 shows a sectional schematic view of the conventional runway having a longitudinally-oriented expansion slit.

FIG. 5A shows a sectional schematic view of the conventional runway having a guide slit.

FIG. 5B shows a sectional schematic view of the conventional runway having a guide slit on which a horizontal expansion slit is formed.

FIG. 6 shows a top view of the conventional runway having a number of checkers formed on the surface layer thereof.

DETAILED DESCRIPTION OF THE INVENTION

The asphalt synthetic agent of the present invention is prepared by melting a straight asphalt and a blown asphalt in an appropriate ratio. The asphalt synthetic agent of the present invention is capable of penetration into the capillary bores of a matrix as well as the surface cracks of the matrix. In addition, the asphalt synthetic agent of the present invention has an excellent adhesion enabling the asphalt synthetic agent to hold together the waterproof rubber cloth and the holding layer of the surface layer of a runway. Furthermore, the asphalt synthetic agent of the present invention is resilient and resistant to water, corrosion and wear.

Figure 21:
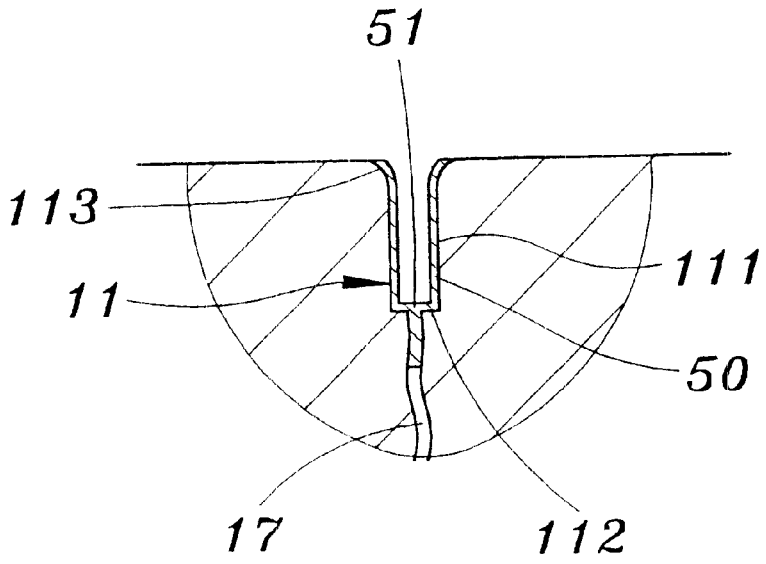
FIG. 21 shows a sectional schematic view of a holding layer formed on the longitudinal expansion slit of the present invention.

The process of the present invention is designed to finish all slits of the surface layer of an airplane runway under construction or in use. The process involves a first step in which a slit to be finished is heated to dry the slit and to open up the capillary bores of the slit. Thereafter, the surface of the slit is coated with an appropriate amount of the asphalt synthetic agent 50, as shown in FIG. 21. The coating 50 is then heated to cause the molecules of the asphalt synthetic agent 50 to move into the capillary holes of the slit until the slit is fully filled with the agent 50. It must be added here that the process of the present invention comprises a preparatory step prior to the first step. The preparatory step includes shores such as slit-sawing, excavating, grinding, cleaning, etc.

Figure 22:
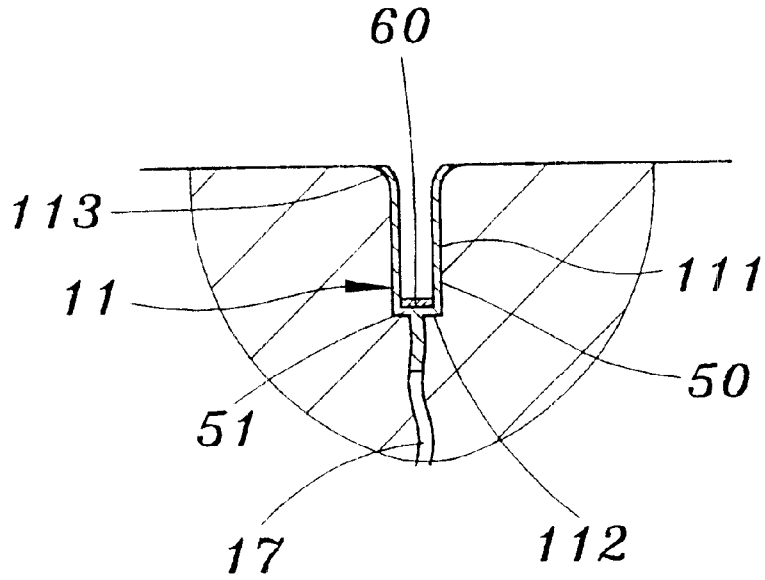
FIG. 22 shows a sectional schematic view of a waterproof rubber cloth covering the holding layer as shown in FIG. 21.
Figure 23:
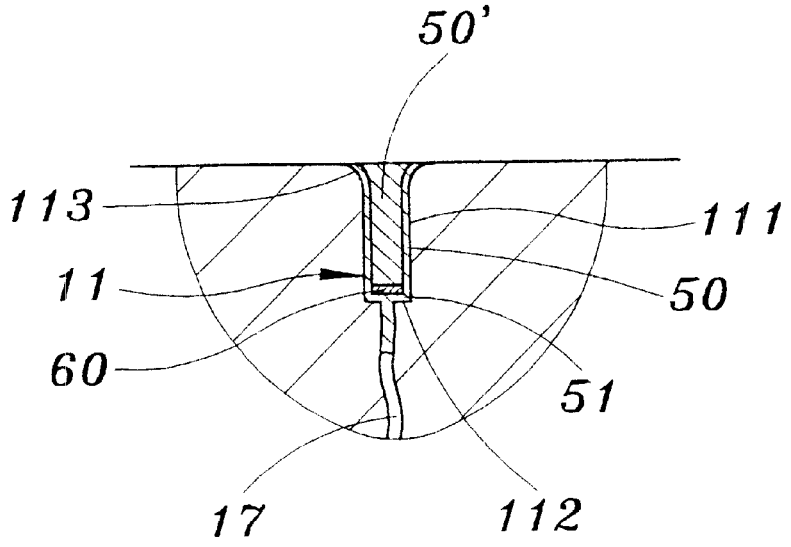
FIG. 23 shows a sectional schematic view of an asphalt synthetic agent filling a longitudinal expansion slit as shown in FIG. 22.

As shown in FIGS. 21, 22, and 23, a longitudinal expansion slit 11 is first heated such that the surface of the longitudinal expansion slit 11 is dry rapidly, and that the capillary holes of the slit 11 are opened up. The dry surface of the slit 11 is then provided with a coating 50 of an asphalt synthetic agent. The coating 50 is heated to cause the molecules of the asphalt synthetic agent 50 to move into the slit side wall 111, the slit bottom wall 112, the capillary holes of the arcuate top comers 113 of the slit 11, and a second process slit 17, As a result, a holding surface 51 is formed, as shown in FIG. 21.

As shown in FIG. 22 the holding surface 51 is provided with a waterproof rubber cloth 60 adhered thereto. Thereafter, the slit 11 is filled with a hot asphalt synthetic agent 50', which is level with the open top of the slit 11, as shown in FIG. 23.

In light of the asphalt synthetic agent 50' and the holding surface 51 being made of the same material, the asphalt synthetic agent 50' is securely attached to the holding surface 51 under the circumstance of expansion and contraction of the runway due to the climatic changes. In addition, the holding surface 51 is secured in place by the slit side wall 111, the slit bottom wall 112, and the capillary holes of the arcuate top corners 113. The longitudinal expansion slit 11 and the second process slit 17 are completely filled with the asphalt synthetic agents 50 and 50' as well as the waterproof rubber cloth 60. In other words, the longitudinal expansion slit 11 is made waterproof in its entirety such that water can not find its way into the gradation layer A of the runway, thereby preventing the formation of a void A1 in the gradation layer A. As a result, the surface layer 10 of the runway is free of a pothole 19. The pothole 19 is further averted by the holding surface 51 which covers the arcuate top corners 113 of the slit 11.

Figure 24:
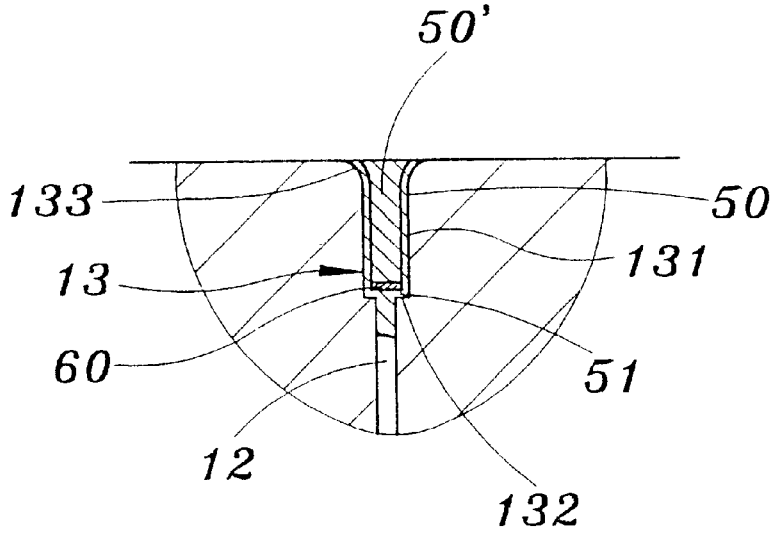
FIG. 24 shows a sectional schematic view of a horizontal expansion slit of the present invention which is filled with an asphalt synthetic agent.
Figure 25:
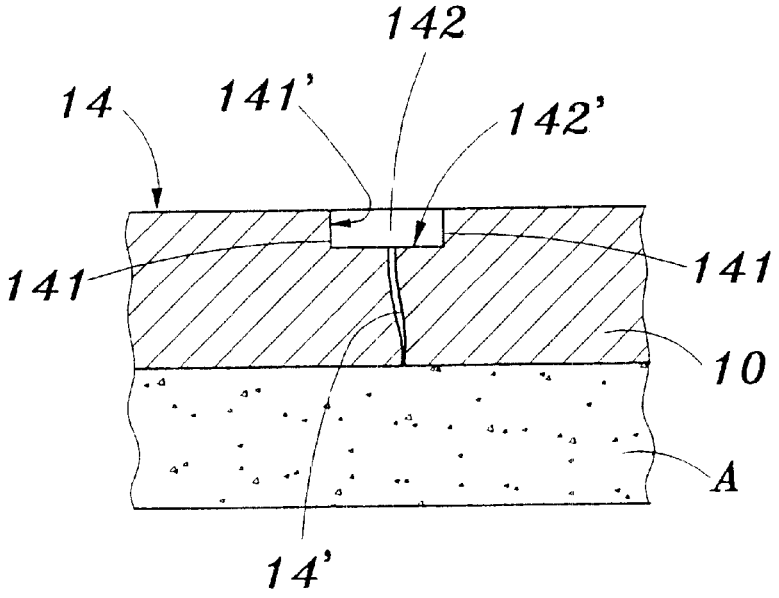
FIG. 25 is a sectional schematic view showing a shallow trench that is formed by cutting on a surface crack of the checkers of the present invention.
Figure 26:
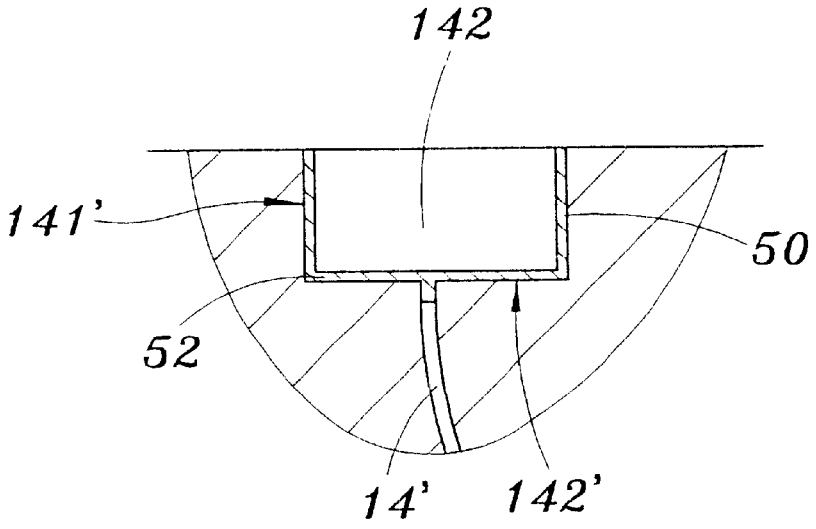
FIG. 26 shows a sectional schematic view of a first holding layer that is formed on the shallow trench as shown in FIG. 25.
Figure 27:
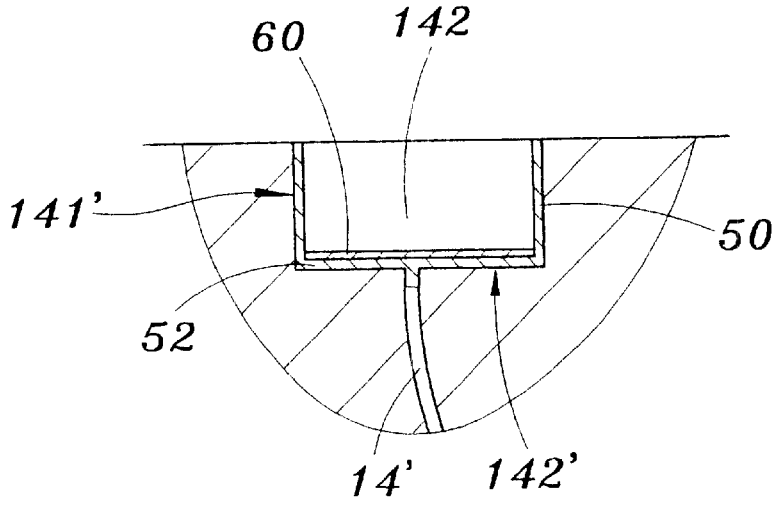
FIG. 27 is a sectional schematic view showing that a waterproof rubber cloth is disposed on the first holding layer as shown in FIG. 26.
Figure 28:
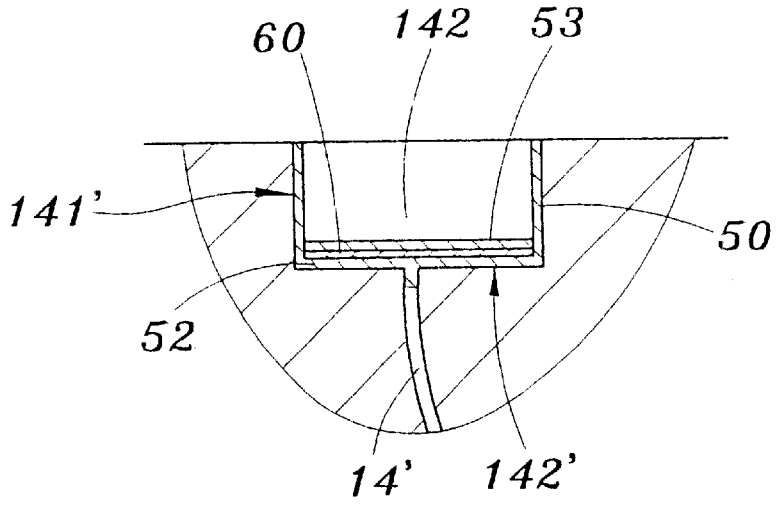
FIG. 28 s a sectional schematic view showing that a second holding layer is formed on the waterproof rubber cloth as shown in FIG. 27.

As shown in FIG. 24, the process of the present invention is sued to finish a horizontal expansion slit 13 of the surface layer 10 of the runway, The process comprises a first step in which the surface of the horizontal expansion slit 13 is heated to dry the slit 13 and to open up the capillary holes of the slit 13. The dry surface of the horizontal expansion slit 13 is then provided with a coating 50 of an asphalt synthetic agent. The coating 50 is heated to cause the molecules of the asphalt synthetic agent to diffuse into the slit side wall 131, the slit bottom wall 132, the capillary holes of the arcuate top corners 133 of the slit 13, and a guide slit 12, thereby resulting in formation of a holding surface 51. The holding surface 51 is then provided with a waterproof rubber cloth 60 adhered thereto. Finally, the horizontal expansion slit 13 is filled with a hot asphalt synthetic agent 50', which is level with the open top of the slit 13.

The treatments of the longitudinal expansion slit 11 and the horizontal expansion slit 13 are identical. For this reason, the water can not find its way into the gradation layer A via the horizontal expansion slit 13. As a result, the gradation layer A is free of a void A1. In the meantime, the surface layer 10 of the runway is free of a pothole 19.

As shown in FIGS. 25–30, the process of the present invention is employed to treat a surface crack 14' of the surface layer 10 of the runway. The process includes a first step in which the checkers 14 of two longitudinal sides of the surface crack 14' are provided with a slender slit 141. Thereafter, the portion of the surface layer 10 located between the two slender slits 141 is removed to form a shallow trench 142 having a width and a depth. The shallow trench 142 is cleaned before it is heated to dry its side walls 141' and bottom wall 142', and to open up the capillary holes of the shallow trench 142. The side walls 141' and the bottom wall 142' of the shallow trench 142 are then provided with a coating 50 of an asphalt synthetic agent. The coating 50 is then heated to cause the molecules of the asphalt synthetic agent to diffuse into the side walls 141', the bottom wall 142', the capillary holes of the shallow trench 142, and the surface crack 14' thereby resulting information of a first holding surface 52. The first holding surface 52 is then provided with a waterproof rubber cloth 60 attached thereto. The waterproof rubber cloth 60 is coated with the asphalt synthetic agent 50 such that a second holding surface 53 is formed on the waterproof rubber cloth 60, as shown is FIG. 28.

Figure 29:
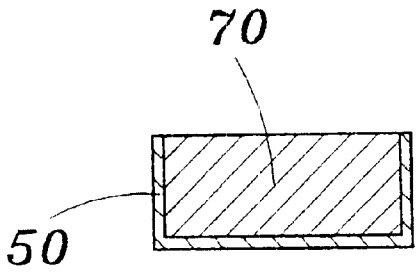
FIG. 29 shows s sectional schematic view of a preformed small matrix of the present invention.

A small matrix 70 is preformed such that the small matrix 70 is corresponding in volume to the shallow trench 142. The small matrix 70 is heated to open up the capillary holes of the surfaces of the small matrix 70. Thereafter, the small matrix 70 is treated in such a way that the capillary holes of the small matrix 70 are filled with the asphalt synthetic agent 50, as shown in FIG. 29.

Figure 30:
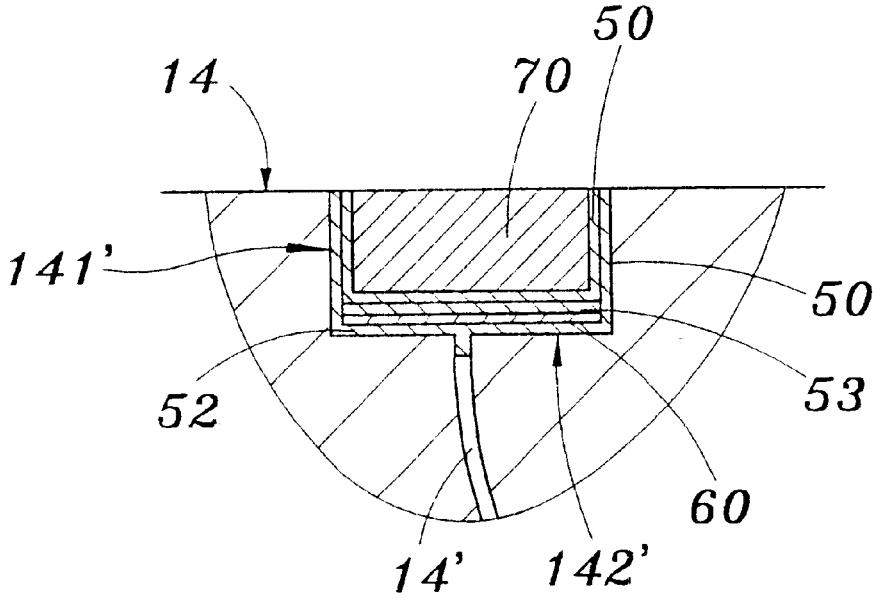
FIG. 30 shows a sectional schematic view of the shallow trench containing the small matrix as shown in FIG. 29.

Before the small matrix 70 is inserted into the shallow trench 142, the surfaces of the small matrix 70 and the second holding surface 53 of the shallow trench 142 are heated, The small matrix 70 is disposed in the shallow trench 142 such that the small matrix 70 is intimately held by the second holding surface 53, as shown in FIG. 30.

In light of the asphalt synthetic agent 50 of the small matrix 70 being identical to the asphalt synthetic agent 50 of the second holding surface 53, the small matrix 70 is held securely in place in the shallow trench 142 such that the small matrix 70 is intimately held by the second holding surface 53, thereby preventing the small matrix 70 from jutting out of the open top of the shallow trench 142.

Figure 1:
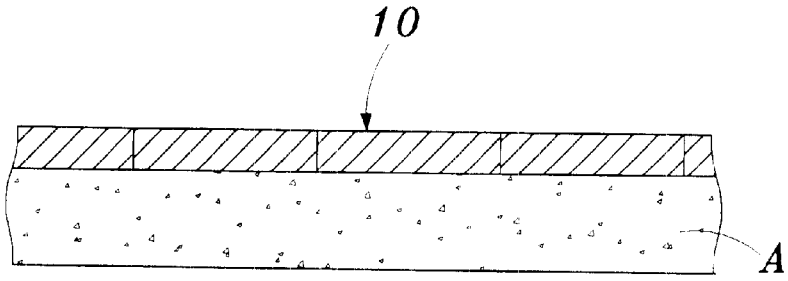
Fig. 1 Prior Art
FIG. 1 shows a cross-sectional view of an airplane runway that is built by the conventional method.
Figure 2:
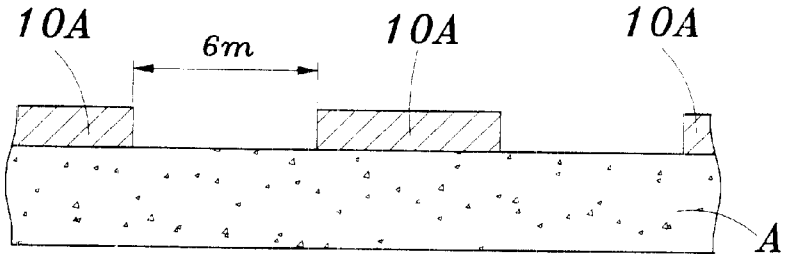
Fig. 2 Prior Art
FIG. 2 shows a sectional schematic view of the conventional runway having surface layer units.
Figure 3:
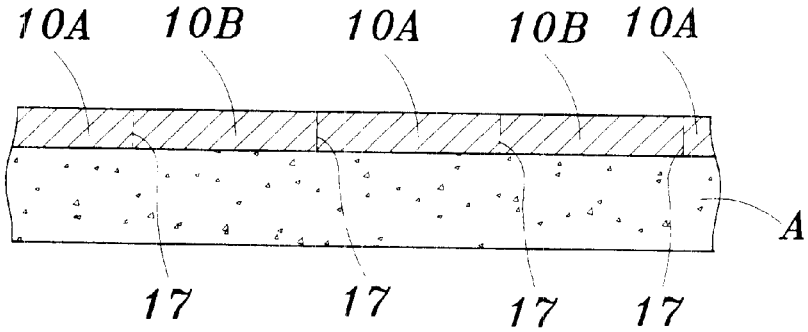
Fig. 3 Prior Art
FIG. 3 shows another sectional schematic view of the conventional runway having surface layer units.
Figure 7:
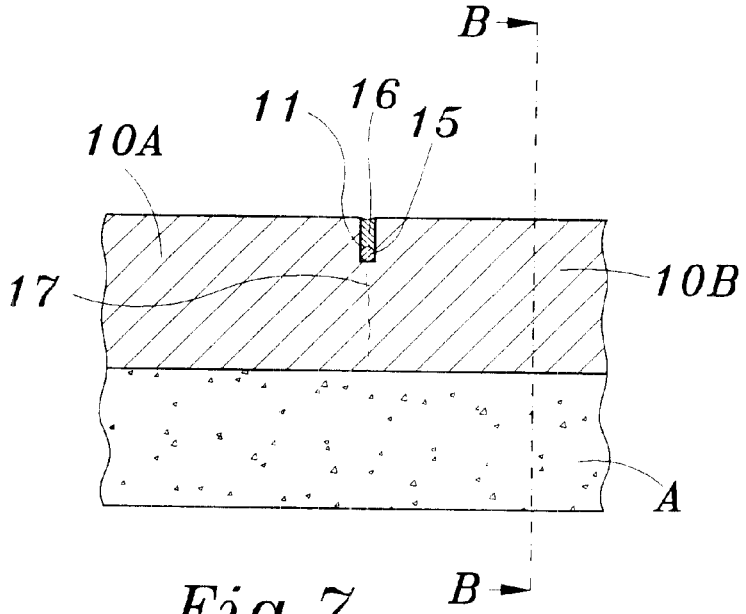
Fig. 7 Prior Art
FIG. 7 shows a sectional schematic view of the waterproof process of the longitudinal expansion slit of the conventional runway.
Figure 8:
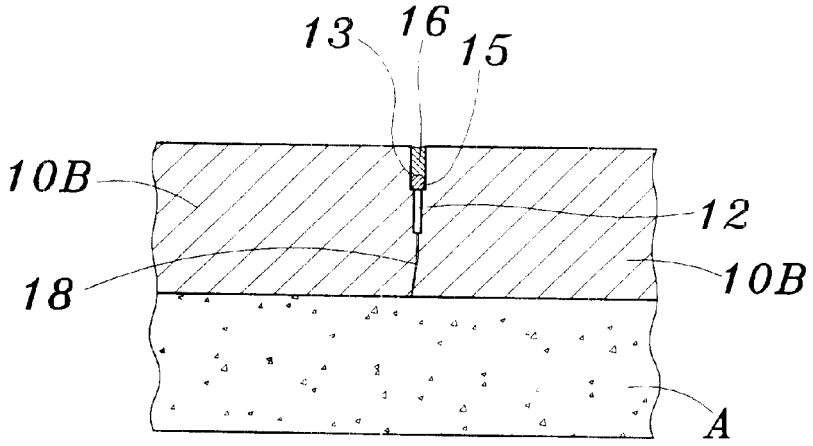
Fig. 8 Prior Art
FIG. 8 shows a sectional view taken along the direction indicated by a line B—B as shown in FIG. 7.
Figure 9:
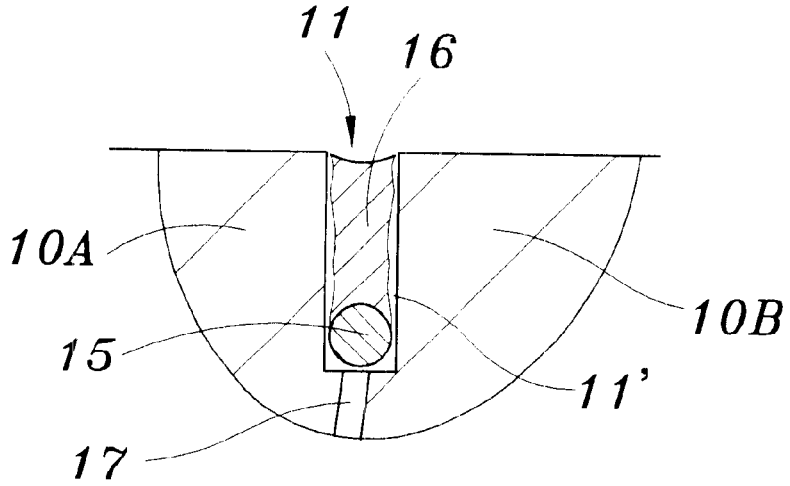
Fig. 9 Prior Art
FIG. 9 shows an enlarged sectional view of a water interstice formed between the longitudinal expansion slit and the slit-filling agent of the conventional runway.
Figure 10:
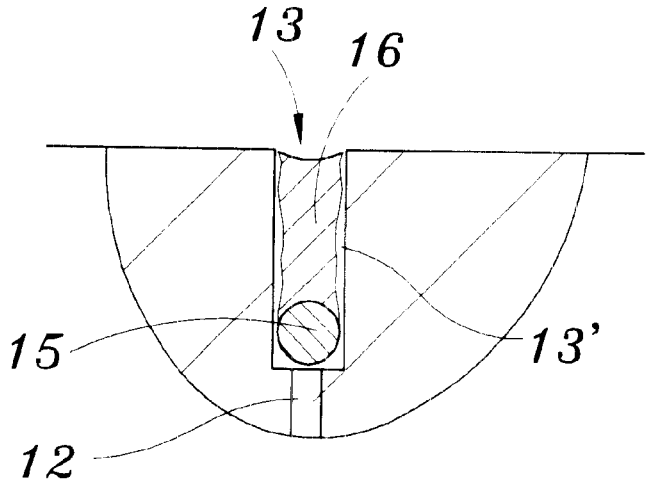
Fig. 10 Prior Art
FIG. 10 shows an enlarged sectional view of a water interstice formed between the horizontal expansion slit and the slit-filling agent of the conventional runway.
Figure 11:
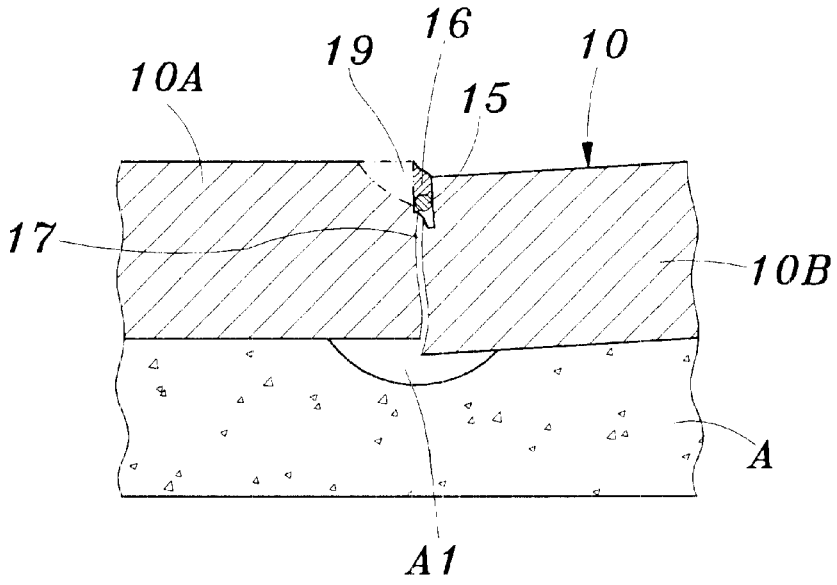
Fig. 11 Prior Art
FIG. 11 shows a sectional schematic view of a crack of the longitudinal expansion slit of the surface layer of the conventional runway.
Figure 12:
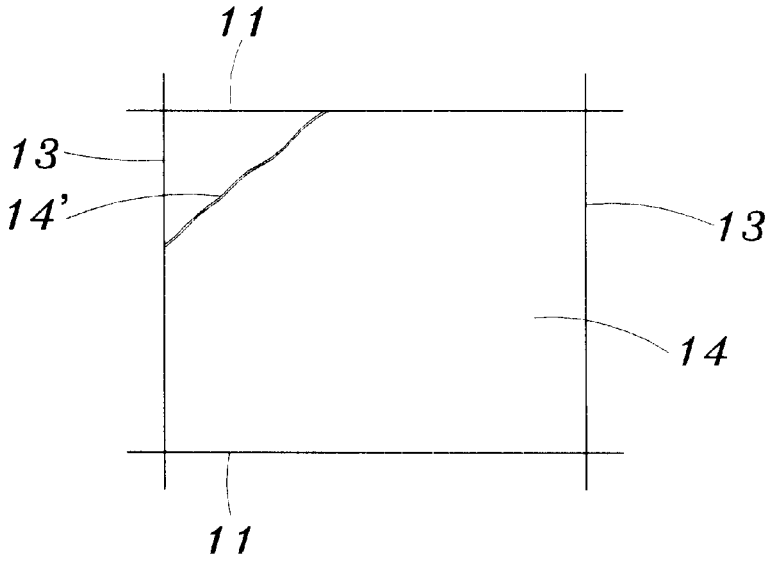
Fig. 12 Prior Art
FIG. 12 shows a top view of a surface crack of the checkers of the surface layer of the conventional runway.
Figure 13:
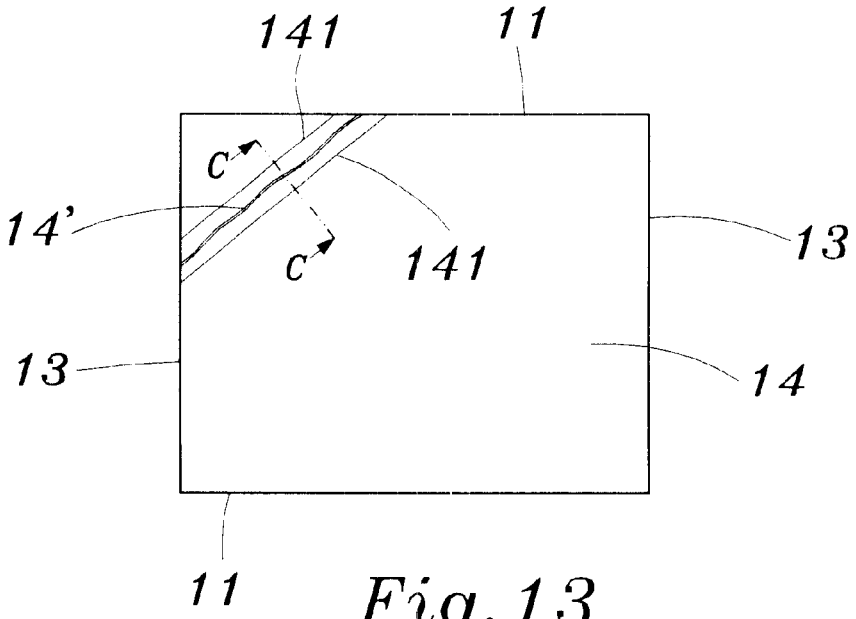
Fig. 13 Prior Art
FIG. 13 shows a top view of two slender slits formed by cutting along two longitudinal sides of the surface crack as shown in FIG. 12.
Figure 14:
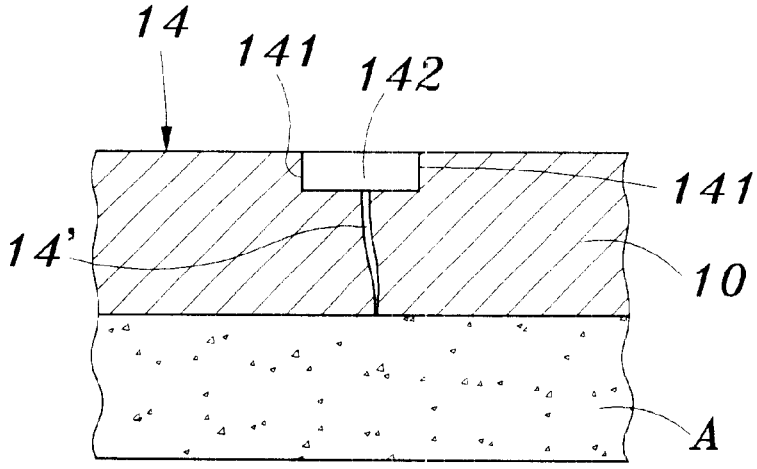
Fig. 14 Prior Art
FIG. 14 shows a sectional view taken along the direction indicated by a line C—C as shown in FIG. 13.
Figure 15:
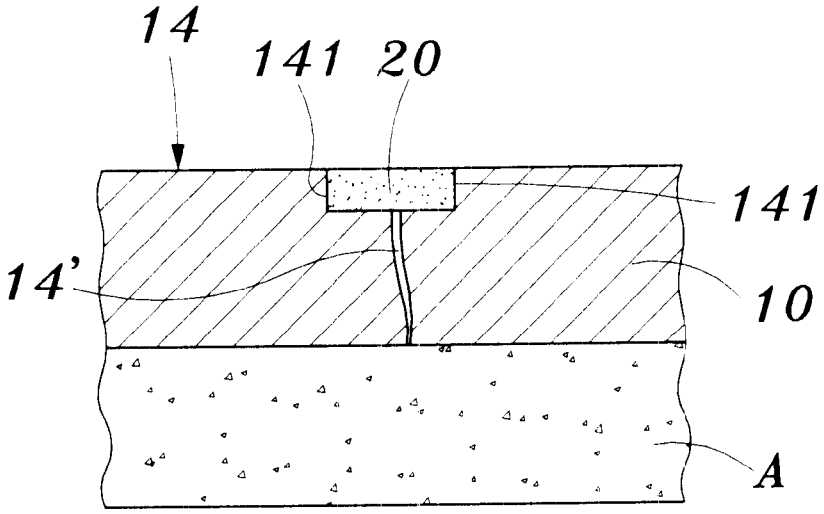
Fig. 15 Prior Art
FIG. 15 shows a sectional schematic view of a filling material disposed in a shallow trench as shown in FIG. 14.
Figure 16:
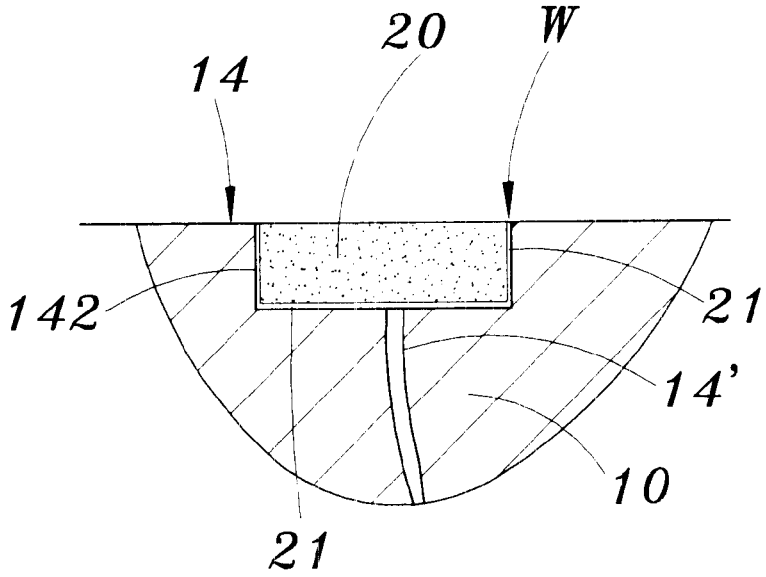
Fig. 16 Prior Art
FIG. 16 shows an enlarged sectional view of a second process slit formed between the filling material and the shallow trench as shown in FIG. 15.
Figure 17:
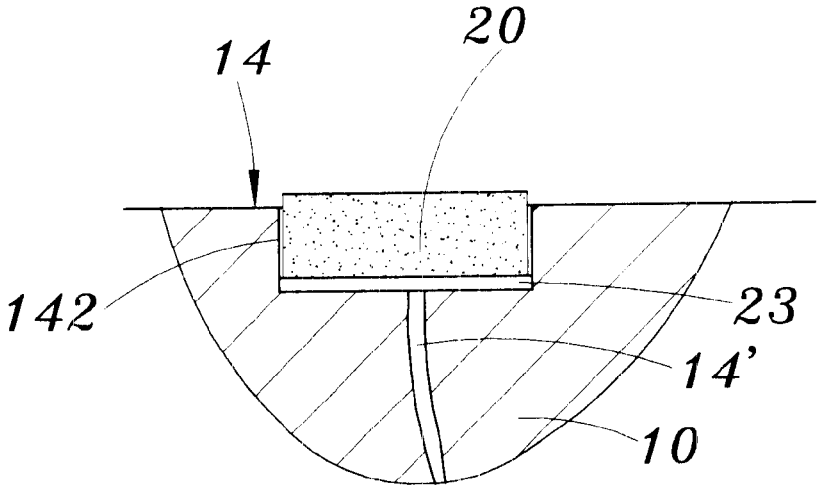
Fig. 17 Prior Art
FIG. 17 shows a sectional schematic view of a protrusion of the filling material as shown in FIG. 16.
Figure 18:
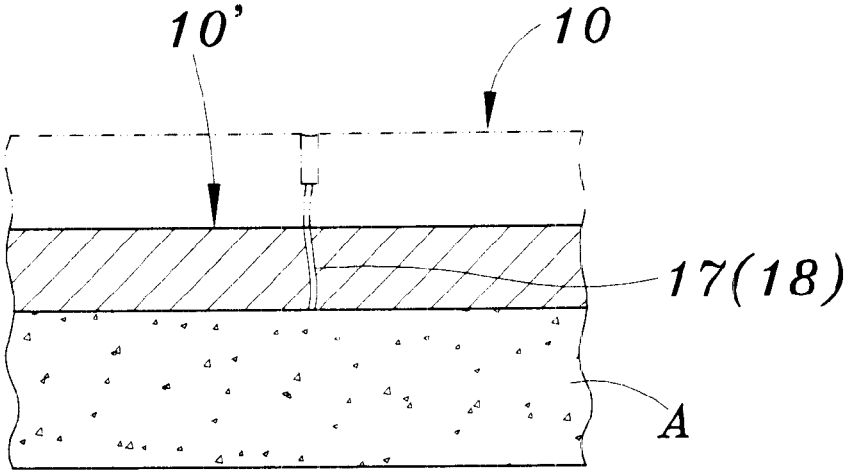
Fig. 18 Prior Art
FIG. 18 shows a sectional schematic view of an intermediate layer of the conventional runway.
Figure 19:
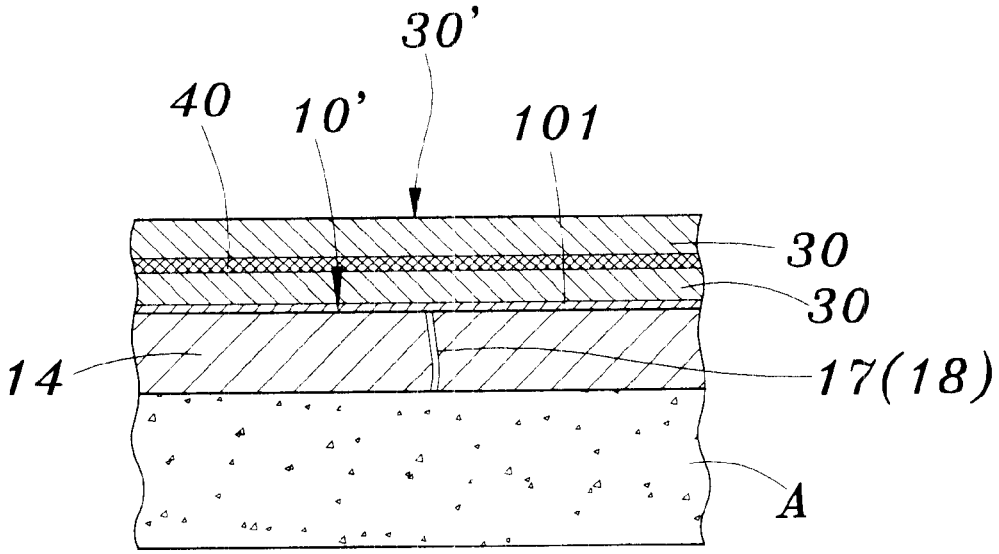
Fig. 19 Prior Art
FIG. 19 shows a sectional schematic view of an intermediate layer of the conventional runway a holding layer formed on the intermediate layer, and a pavement reinforcing fabric covering the holding layer.
Figure 20:
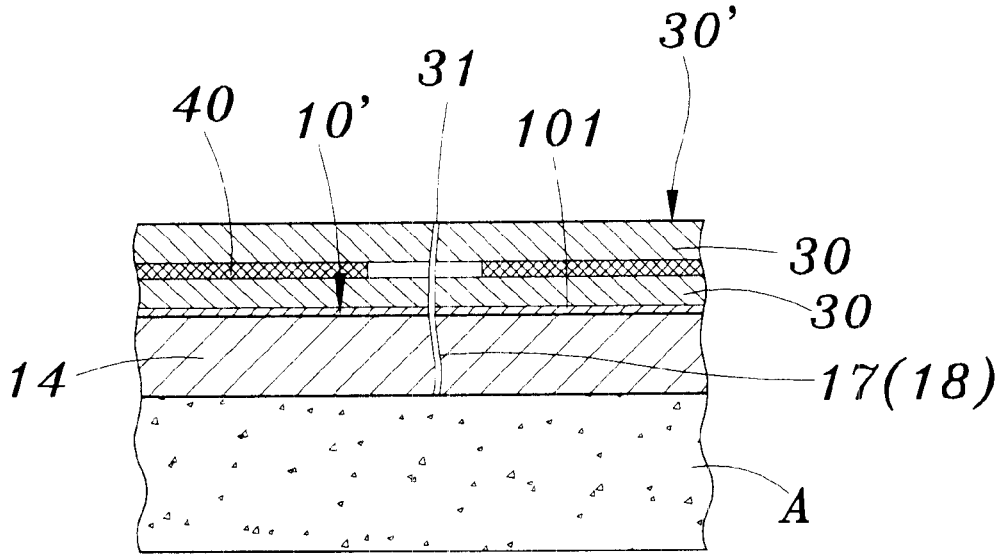
Fig. 20 Prior Art
FIG. 20 shows a sectional schematic view of a reflective crack formed in the surface layer of the conventional runway.

The incident of the filling material 20 jutting out of the second process slit 21 of the conventional runway, as illustrated in FIGS. 16 and 17, can be thus averted by the process of the present invention.

Figure 31:
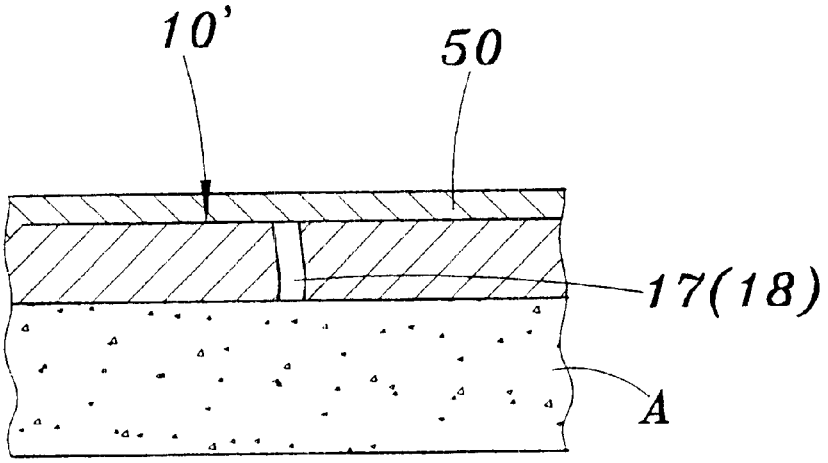
FIG. 31 shows a sectional schematic view of an intermediate layer of the surface layer of the present invention which is paved with an asphalt synthetic agent.
Figure 32:
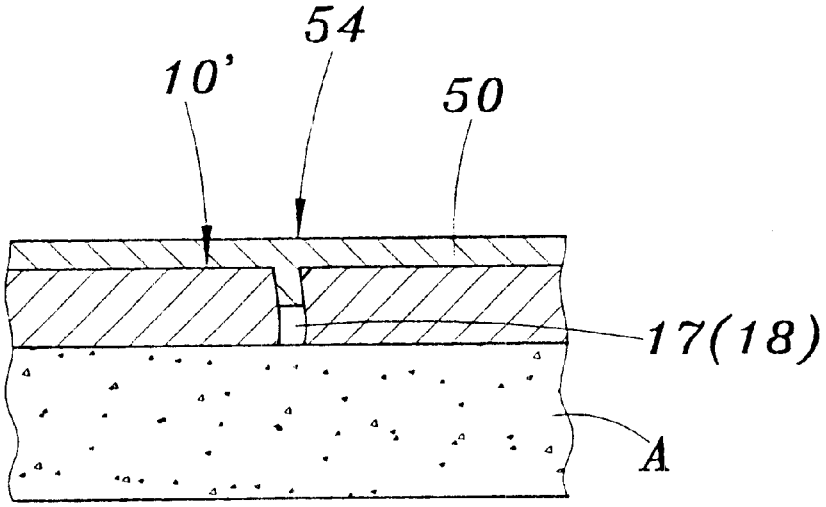
FIG. 32 shows a sectional schematic view of all slits of the surface layer of the present invention and an asphalt synthetic agent covering the slits.
Figure 33:
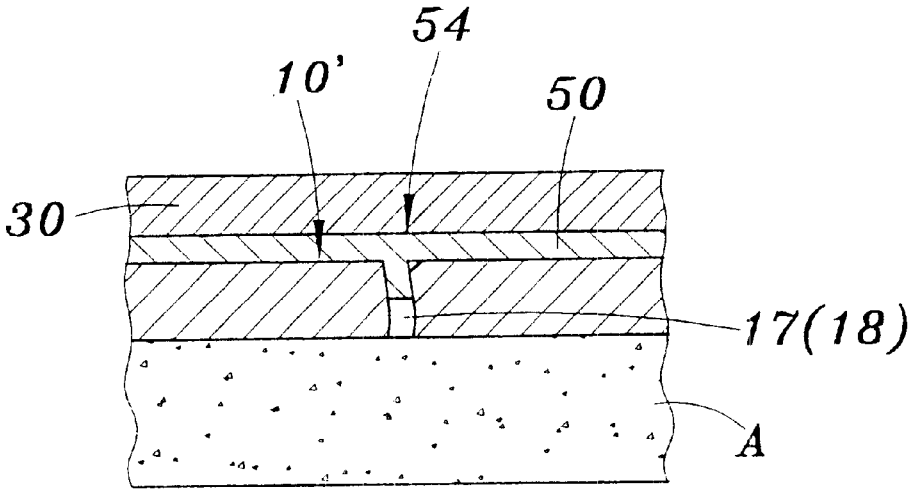
FIG. 33 shows a sectional schematic view of the surface layer of the present invention and an asphalt concrete paving the surface layer.
Figure 34:
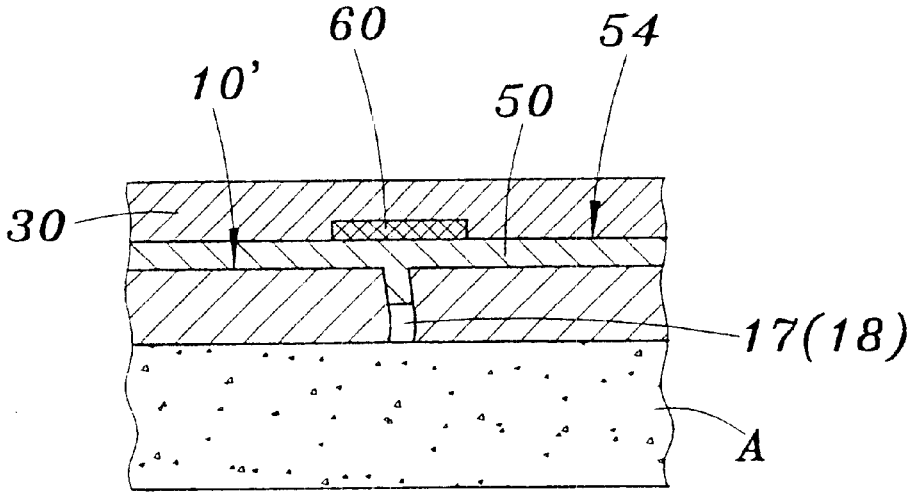
FIG. 34 shows a sectional schematic view of the surface layer of the present invention containing a waterproof rubber cloth and an asphalt concrete covering the waterproof rubber cloth.

As illustrated in FIGS. 31 to 34, a process of the present invention is employed to rebuild the surface layer 10 of the runway. The process begins with the removal of an appropriate thickness of the surface layer 10, thereby resulting in an intermediate layer 10', which is then provided with a coating 50 of an asphalt synthetic agent, as shown in FIG. 31. The coating 50 is heated such that the molecules of the asphalt synthetic agent of the coating 50 diffuse into the capillary holes of the surfaces of all silts of the intermediate layer 10', thereby resulting in formation of a holding surface 54, as shown in FIG. 32. It must be noted here that the asphalt synthetic agent also diffuses into the capillary holes of the surfaces of the second process slit 17 and the through slit 18. The holding surface 54 is then paved with an asphalt concrete 30 having an appropriate thickness and conforming to the runway specifications, as illustrated in FIG. 33. The holding surfaces 54 of the longitudinal expansion slit 11, the guide slit 12, the horizontal expansion slit 13, the second process slit 17, and the through slit 18 are provided with a waterproof rubber cloth 60 attached thereto, as shown in FIG. 34. When all the slits of the runway are exerted on by the reaction force of an airplane or heavy-duty vehicle, or by a vertical internal stress brought about by the climatic changes, the slits are capable of converting the vertical internal stress into a horizontal action force, thanks to the holding surface 54 and the waterproof rubber cloth 60. As a result, the new surface layer 10' is free of the reflective slit, In addition, the holding surface 54 and the waterproof rubber cloth 60 serve to prevent the water "W" from finding its way into the gradation layer A of the runway. The new surface layer 10' of the runway does not cave in. In view of the lack of the voids in the gradation layer A of the runway, the new surface layer 10' of the runway is immune from pothole.

The processes of the present invention described above are equally applicable to taxiway, apron, hangar, highway, bridge surface, and the like.

What is claimed is:

1. A process for finishing an expansion slit of a surface layer of a runway for protecting from being cracked to split out crush stones, comprising the steps of:

(a) heating surfaces of side walls, a bottom wall and arcuate top corners of said expansion slit of said surface layer to dry said side walls, said bottom wall and said arcuate top corners and open up capillary bores of said surfaces of said expansion slit;

(b) coating said surfaces of said side walls, said bottom wall and said arcuate top corners of said expansion slit with a coating of asphalt synthetic agent, which has a predetermined thickness and is made by melting a straight asphalt and a blown asphalt to form a mixture with a predetermined ratio, wherein a top portion of a second slit extended downwardly from said bottom wall of said expansion slit is filled with a section of said asphalt synthetic agent;

(c) heating said coating of asphalt synthetic agent coated on said surfaces of said side walls, said bottom wall and said arcuate top corners to cause molecules of said coating of asphalt synthetic agent to diffuse into said capillary holes of said surfaces of said side walls, said bottom wall and arcuate top corners of said expansion slit to form a holding surface on said surfaces of said expansion slit;

(d) attaching a waterproof rubber cloth on a bottom of said holding surface to waterproof said second slit from outside; and (e) filling a gap defined between two sides of said holding surface and said waterproof rubber cloth adhered at said bottom of said holding surface of said expansion slit with a hot asphalt synthetic agent until said hot asphalt synthetic agent is level with an open top of said expansion slit.

2. The process, as recited in claim 1, wherein said expansion slit is a longitudinal expansion slit and said second slit is a second process slit.

3. The process, as recited in claim 1, wherein said expansion slit is a horizontal expansion slit and said second slit is a guide slit.

4. A process for finishing a surface crack of a surface layer of a runway for protecting from being cracked to split out crush stones, comprising the steps of:

(a) forming two slender slits extending along two longitudinal sides of a top portion of said surface crack;

(b) removing a portion of said surface layer located between said two slender slits to form a shallow trench having a width and a depth;

(c) cleaning said shallow trench and heating said shallow trench to dry side walls and a bottom wall of said shallow trench to open up capillary holes of said side walls and said bottom wall of said shallow trench;

(d) coating said side walls and said bottom wall of said shallow trench with a coating of asphalt synthetic agent, which has a predetermined thickness and is made by melting a straight asphalt and a blown asphalt to form a mixture with a predetermined ratio;

(e) heating said coating of asphalt synthetic agent coated on said side walls and said bottom wall of said shallow trench to cause molecules of said coating of asphalt synthetic agent to diffuse into said capillary holes of said side walls and said bottom wall of said shallow trench to form a first holding surface on said side walls and said bottom wall of said shallow trench;

(f) attaching a waterproof rubber cloth on a bottom of said first holding surface to waterproof said surface crack positioned right below said shallow trench from outside;

(g) coating said waterproof rubber cloth on top of said bottom of said first holding surface with another coating of asphalt synthetic agent to form a second holding surface on said waterproof rubber cloth and define a cavity between said second holding surface coated on said waterproof rubber cloth and said first holding surface coated on said side walls of said shallow trench;

(h) providing a matrix having a size adapted for filling said cavity of said shallow trench space;

(i) heating side walls and a bottom wall of said matrix to open capillary holes of said side walls and said bottom wall and filling said capillary holes of said matrix with an asphalt synthetic agent;

(j) heating said side walls and said bottom wall of said matrix and said second holding surface of said shallow trench; and (k) disposing said matrix into said cavity of said shallow trench wherein said matrix is intimately held by said second holding surface so as to prevent said matrix from jutting out of an open top of said shallow trench.

5. A process for rebuilding a surface layer with at least a slit thereon of a runway for protecting from being cracked to split out crush stones, comprising the steps of:

(a) removing an upper portion of said surface layer leaving a lower portion of said surface layer as an intermediate layer;

(b) coating a top surface of said intermediate layer with a coating of asphalt synthetic agent;

(c) heating said coating of asphalt synthetic agent to cause molecules of said coating of asphalt synthetic agent to diffuse into capillary holes of said top surface of said intermediate layer and side walls of said slit formed on said intermediate layer to form a holding surface;

(d) attaching a waterproof rubber cloth on said holding surface, wherein said waterproof rubber cloth is extended along said slit and has a width larger than a width of said slit to waterproof said slit; and (e) paving an asphalt concrete, having a thickness equal to said thickness of said removed upper portion of said surface layer, on said holding surfaces.

6. The process, as recited in claim 5, in the step (b), wherein a top portion of said slit is filled with said coating of asphalt synthetic agent.

7. The process, as recited in claim 6, wherein said slit is a longitudinal expansion slit.

8. The process, as recited in claim 6, wherein said slit is a horizontal expansion slit.

9. The process, as recited in claim 6, wherein said slit is a guide slit.

10. The process, as recited in claim 6, wherein said slit is a through slit.

11. The process, as recited in claim 5, wherein said slit is a longitudinal expansion slit.

12. The process, as recited in claim 5, wherein said slit is a horizontal expansion slit.

13. The process, as recited in claim 5, wherein said slit is a guide slit.

14. The process, as recited in claim 5, wherein said slit is a through slit.

* * * * *